United States Patent [19]

Krause

[11] 4,322,481

[45] Mar. 30, 1982

[54] LOSS CHARACTERISTICS IN AMORPHOUS MAGNETIC ALLOYS

[75] Inventor: Robert F. Krause, Murrysville, Pa.

[73] Assignee: Westinghouse Electric Corp., Pittsburgh, Pa.

[21] Appl. No.: 119,688

[22] Filed: Feb. 8, 1980

[51] Int. Cl.[3] ..... H01F 1/00

[52] U.S. Cl. ..... 428/611; 428/573; 428/687; 428/928; 148/31.55; 148/120

[58] Field of Search ..... 148/31.55, 31.57, 101, 148/120; 428/573–575, 611, 687, 928; 360/131, 134; 358/128.5, 128.6

[56] References Cited

U.S. PATENT DOCUMENTS

| | | | |
|---|---|---|---|
| 2,234,968 | 3/1941 | Hayes et al. | 148/120 |
| 3,647,575 | 3/1972 | Fiedler et al. | 148/111 |
| 3,947,296 | 3/1976 | Kumazawa | 148/111 |
| 3,979,541 | 9/1976 | DeSourdis | 360/134 |
| 4,077,051 | 2/1968 | Vossen | 358/128 |
| 4,144,058 | 3/1979 | Chen | 75/170 |

*Primary Examiner*—L. Dewayne Rutledge
*Assistant Examiner*—John P. Sheehan
*Attorney, Agent, or Firm*—R. A. Stoltz; J. J. Prizzi

[57] ABSTRACT

It has been discovered that a series of grooves in the surface of amorphous magnetic alloy strip can significantly reduce core losses if the grooves are generally transverse to the direction of magnetization. The grooves are between 0.1 and 10.0 of the strip thickness in depth and are preferably on both sides of the strip and spaced about 0.02–2 centimeters apart.

4 Claims, 12 Drawing Figures

LOSS CHARACTERISTICS IN AMORPHOUS MAGNETIC ALLOYS

BACKGROUND OF THE INVENTION

This invention relates to magnetic materials useful in electrical apparatus such as transformers, and more particularly to amorphous magnetic alloys and to a configuration which reduces losses during their operation.

There has been considerable interest in the use of transition metal based amorphous alloys as possible magnetic core materials (e.g. for transformers). These alloys, which are typically produced by rapidly cooling a jet of liquid metal against the surface of a rapidly rotating cylinder, exhibit no magnetocrystalline anisotropy. Generally electrical resistivities are two-three times higher than in traditional Fe-Si or Ni-Fe magnetic alloy systems and low coercivities and core losses are exhibited in the as-cast state. In addition, the magnetic properties can be further improved by a stress relief anneal and also by cooling in the presence of an applied magnetic field. Despite the low coercivities and high resistivities, the losses (although very good) have in the past been generally inferior to the commercially available 4-79 Permalloy.

A variety of commercially available amorphous magnetic alloys are available (for example, "Metaglas", Registered Trademark Allied Chemical Corp.). The type referred to herein as 2605A has a $Fe_{78}Mo_2B_{20}$ composition and a relatively high saturation. The type referred to herein as 2826 (see U.S. Pat. No. 4,144,058) has a $Fe_{40}Ni_{40}P_{14}B_6$ composition and a somewhat lower saturation. The type referred to herein as 2826MB is an amorphous magnetic alloy related to the 2826 and has a $Fe_{40}Ni_{38}Mo_4B_{18}$ composition.

SUMMARY OF THE INVENTION

It has been discovered that the core losses of amorphous magnetic alloy cores can be reduced by a series of grooves on the amorphous-metal surface in a direction generally transverse to the direction of magnetization. Such grooves are especially effective at higher frequencies (above about 1000 hertz), but it is felt that proper groove sizing and spacing makes grooving effective at lower frequencies as well. The grooving is effective for both high and lower saturation amorphous magnetic alloys, but the effect is more readily apparent in higher saturation alloys. A series of grooves (at least three) are to be on at least one surface (and preferably both surfaces) of the strip. The grooves are to have a depth of about 0.1–10 percent of the strip thickness and are to run generally transverse to the direction of magnetization.

BRIEF DESCRIPTION OF THE DRAWINGS

A better understanding of the invention may be had by reference to the drawings in which.

DESCRIPTION OF THE PREFERRED EMBODIMENT

It was theorized that scratches (grooves) transverse to the direction of magnetization might increase the magnetostatic energy of an amorphous alloy in a manner to cause closure domains to form and in turn result in the refinement of the 180° domain wall spacing. If such a refinement occurred, eddy current losses would be reduced and, if such reduction was greater than the increase hysteresis losses caused by the surface grooving, total losses would be reduced. Whatever the explanation, a series of tests showed that a series grooves transverse to the direction of magnetization can indeed reduce the total core losses.

It should be noted that whatever mechanicam is involved, it is not related to the surface scratching of materials such as hypersil prior to box anneal, as such practices are for grain refinement and the amorphous magnetic alloys have, of course, no grains (nor, of course, is there any direct relation between the direction of scratching for grain refinement and the direction of magnetization).

For ease of experimentation, grooves were inserted by scratching both the surfaces with emery paper. The effect of varying the grit size of the emery paper was also investigated. Samples which were scratched transverse to the direction of magnetization were compared with both unscratched samples and samples scratched parallel to the direction of magnetization.

The effect of scratch direction in 2605A with a magnetic field anneal was evaluated using three nominally 5 grams lengths of 40 mil wide, ~2 mil thick alloy 2605A. The properties of 2605A (and 2826 and 2826M) are shown in TABLE I below. Length 1 was coated with a magnesium methylate insulation and wound into a rectangular core. Length 2 was scratched on both sides with 280 grit emery paper, with the direction of scratching parallel to the strip length (i.e., parallel to the direction of magnetization). Length 3 was also scratched with 280 grit emery paper with the scratches transverse to the strip length.

TABLE I

| ALLOY INITIAL PROPERTIES | Alloy Number | | |
|---|---|---|---|
| | 2605A | 2826 | 2826MB |
| Resistivity, $\mu\Omega$cm | 160 | 180 | 160 |
| Saturation Induction, kG | 13.4 | 7.8 | 8.8 |
| Coercive Force, Oersted | .07 | .06 | .10 |
| Density, gm/cm$^3$ | 7.4 | 7.5 | 8.0 |
| Composition, atomic percent | 78 Fe | 40 Fe | 40 Fe |
| | 2 Mo | 40 Ni | 38 Ni |
| | 20 B | 14 P | 4 Mo |
| | | 6 B | 18 B |

Both strips 2 and 3 were insulated and wound into rectangular cores. All three cores were magnetically annealed for 2 hours at 325° C. in a nitrogen atmosphere and furnace cooled. The cooling rate was less than 4° C./minute over the temperature range 325° to 150° C.

Figure 1:
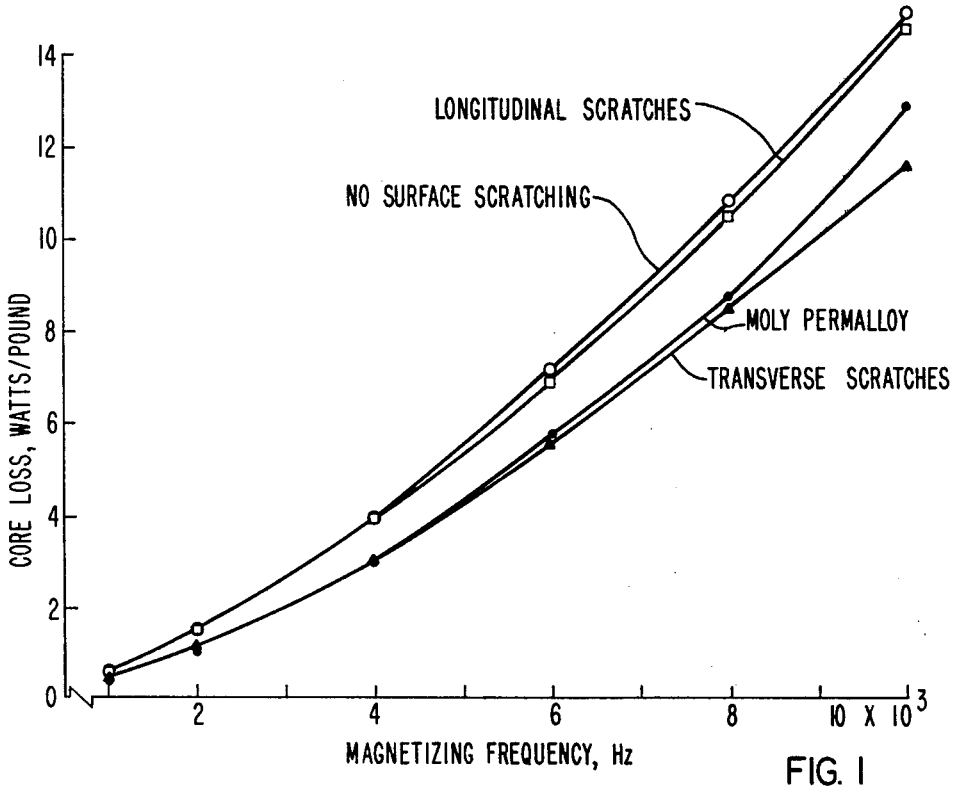
FIG. 1 shows variation in core loss with magnetizing frequency at an induction of 4 kG for a high saturation (2605A) alloy and Moly Permalloy.
Figure 2:
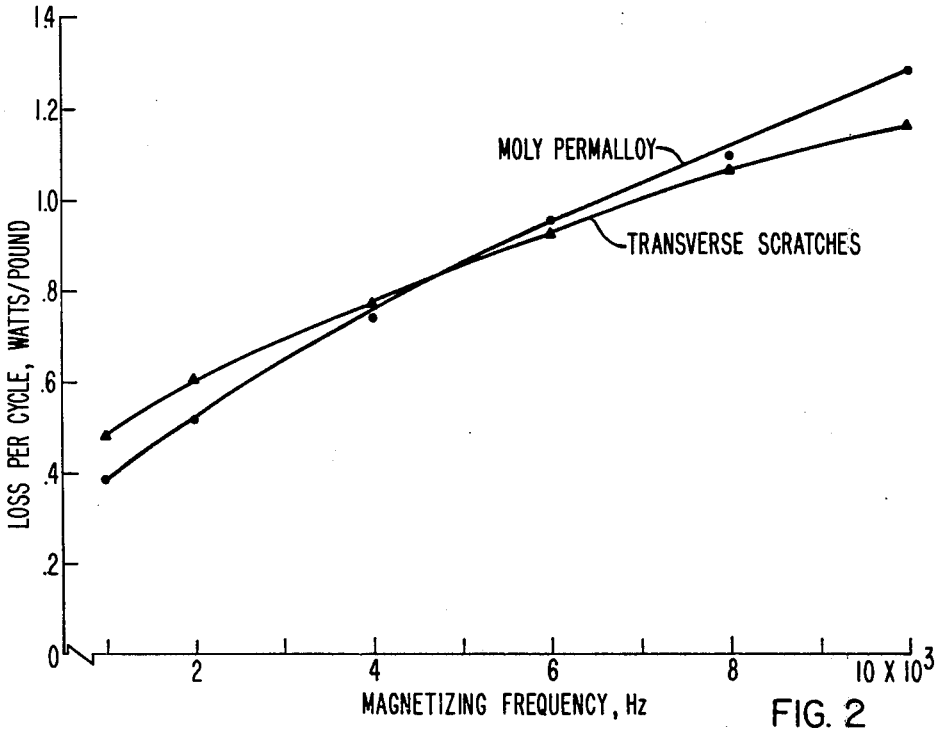
FIG. 2 compares the loss/cycle of Moly Permalloy and transversely grooved (scratched) 2605A at an induction of 4 kG.

The three strips were tested at frequencies from 1 to 10 kHz. The results appear in TABLE II below. The 4 kG results are presented in FIG. 1 and compared to a Moly Permalloy core. This data indicates that transverse scratching results in an appreciable reduction in core loss while longitudinal scratching has little effect on core loss and also, that core 3 is superior to Moly Permalloy in the high frequency range. FIG. 2 indicates that core 3 continue to remain superior to Moly Permalloy at frequencies higher than tested.

TABLE II

| EFFECT OF SURFACE SCRATCHING ON ALLOY 2605A MAGNETICALLY ANNEALED AT 325° C. | | | | | | |
|---|---|---|---|---|---|---|
| Test | Core Loss, Watts/Pound | | | | | |
| Frequency | .5 kG | 1 kG | 2 kG | 3 kG | 4 kG | 5 kG |
| | No Surface Scratching | | | | | |
| 1000 | .014 | .055 | .183 | .353 | .558 | .838 |
| 2000 | .035 | .135 | .474 | .938 | 1.52 | 2.21 |
| 4000 | .092 | .357 | 1.28 | 2.46 | 3.98 | 5.95 |
| 6000 | .164 | .638 | 2.22 | 4.46 | 7.11 | 10.7 |
| 8000 | .248 | .972 | 3.35 | 6.50 | 10.8 | 16.1 |
| 10000 | .354 | 1.38 | 4.66 | 9.01 | 14.8 | 22.0 |
| | Longitudinal Scratches | | | | | |
| 1000 | .017 | .066 | .217 | .405 | .621 | .862 |
| 2000 | .038 | .150 | .517 | .997 | 1.56 | — |
| 4000 | .093 | .370 | 1.31 | 2.49 | 3.90 | 5.49 |
| 6000 | .157 | .629 | 2.26 | 4.36 | 6.91 | 9.84 |
| 8000 | .232 | .927 | 3.24 | 6.57 | 10.5 | 14.9 |
| 10000 | .321 | 1.28 | 4.56 | 9.17 | 14.6 | — |
| | Transverse Scratches | | | | | |
| 1000 | .010 | .040 | .149 | .302 | .482 | .689 |
| 2000 | .024 | .094 | .364 | .752 | 1.22 | 1.71 |
| 4000 | .060 | .256 | .971 | 1.90 | 3.08 | 4.46 |
| 6000 | .110 | .439 | 1.61 | 3.36 | 5.55 | 7.84 |
| 8000 | .171 | .678 | 2.44 | 5.13 | 8.51 | 12.2 |
| 10000 | .240 | .954 | 3.41 | 7.19 | 11.6 | 17.0 |

Figure 3:
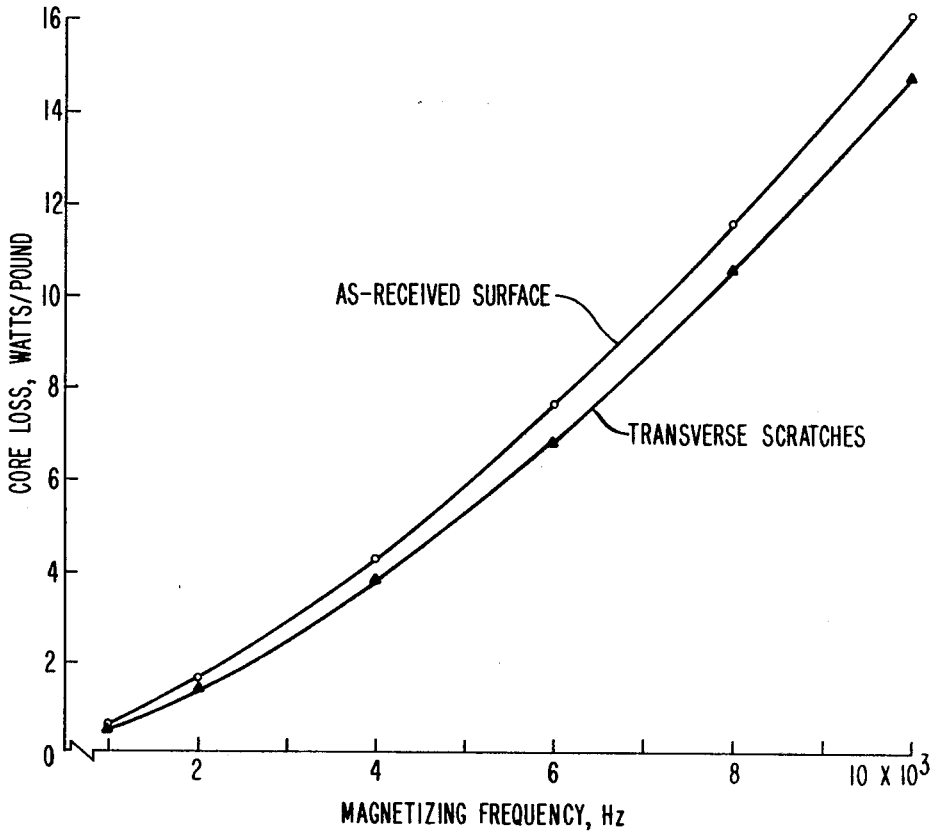
FIG. 3 shows the effect of surface scratching on the magnetic properties (at 4 kG) of annealed 2605A.

To evaluate the effect of transverse scratches on 2605A without a magnetic field anneal, two wound cores were made from alloy 2605A. One strip was coated with magnesium methylate and wound. A second strip was scratched on both sides with fine (280 grit) emery paper. The direction of scratching was transverse to the strip axis. This material was then coated and wound. Both cores were annealed for 2 hours at 325° C. in dry hydrogen and furnace cooled. No magnetic field was applied during the anneal. The test results appear in TABLE III below and the 4 kG losses as a function of frequency are shown in FIG. 3. As can be seen, transverse scratching resulted in an improved core loss.

TABLE III

| EFFECT OF SURFACE SCRATCHING ON ALLOY 2605A ANNEALED AT 325° C. | | | | | | |
|---|---|---|---|---|---|---|
| Test | Core Loss, Watts/Pound | | | | | |
| Frequency | .5 kG | 1 kG | 2 kG | 3 kG | 4 kG | 5 kG |
| | No Surface Scratches | | | | | |
| 1000 | .016 | .062 | .209 | .399 | .616 | .856 |
| 2000 | .042 | .161 | .545 | 1.04 | 1.61 | 2.25 |
| 4000 | .116 | .428 | 1.43 | 2.75 | 4.28 | 5.98 |
| 6000 | .198 | .746 | 2.51 | 4.89 | 7.62 | 10.8 |
| 8000 | .283 | 1.06 | 3.70 | 7.30 | 11.6 | 16.3 |
| 10000 | .372 | 1.44 | 5.16 | 10.2 | 16.1 | 23.2 |
| | Transverse Scratches | | | | | |
| 1000 | .013 | .050 | .178 | .347 | .549 | .776 |
| 2000 | .032 | .129 | .456 | .896 | 1.42 | 2.01 |
| 4000 | .089 | .343 | 1.20 | 2.38 | 3.81 | 5.36 |
| 6000 | .159 | .609 | 2.13 | 4.29 | 6.84 | 9.82 |
| 8000 | .242 | .925 | 3.25 | 6.51 | 10.6 | 15.1 |
| 10000 | .344 | 1.29 | 4.55 | 9.10 | 14.8 | 21.5 |

The following was performed to evaluate the effect of fine scratches on low saturation alloy (2826). If transverse surface scratches reduce losses by altering the magnetostatic energy of the amorphous magnetic alloys, the lower the magnetic saturation of any alloy, the smaller would be the expected effect of this type of surface treatment. Alloy 2826 has a much lower saturation magnetization than alloy 2605A. Two cores of 2826 were prepared, as previously described, and annealed in the absence of a magnetic field at 325° C. The surface of one core was in the as-received condition while the material in the other core was scratched in the transverse direction with 280 grit emery paper. The test results appear in TABLE IV below. As can be seen there is little difference between the two cores. In fact, the scratched core is slightly poorer than the unscratched core. This difference could be due to the incomplete removal of residual scratching stresses or could be due to sample or test variations. These results tend to support the magnetostatic energy hypothesis.

TABLE IV

| EFFECT OF SURFACE SCRATCHING ON ALLOY 2826 ANNEALED AT 325° C. | | | | | | |
|---|---|---|---|---|---|---|
| Test | Core Loss, Watts/Pound | | | | | |
| Frequency | .5 kG | 1 kG | 2 kG | 3 kG | 4 kG | 5 kG |
| | No Surface Scratches | | | | | |
| 1000 | .019 | .068 | .204 | .335 | .581 | .778 |
| 2000 | .043 | .162 | .523 | .973 | 1.50 | 2.04 |
| 4000 | .107 | .412 | 1.41 | 2.67 | 4.11 | 5.71 |
| 6000 | .181 | .708 | 2.52 | 4.90 | 7.58 | 10.6 |
| 8000 | .265 | 1.05 | 3.77 | 7.43 | 11.9 | 16.6 |
| 10000 | .359 | 1.43 | 5.21 | 10.5 | 16.8 | 23.8 |
| | Longitudinal Scratches | | | | | |
| 1000 | .022 | .074 | .223 | .403 | .627 | .832 |
| 2000 | .048 | .173 | .554 | 1.03 | 1.50 | 2.16 |
| 4000 | .119 | .437 | 1.44 | 2.71 | 4.16 | 5.86 |
| 6000 | .201 | .753 | 2.56 | 4.90 | 7.66 | 10.8 |
| 8000 | .296 | 1.12 | 3.82 | 7.56 | 12.0 | 17.0 |
| 10000 | .405 | 1.53 | 5.30 | 10.4 | 16.8 | 24.5 |

Figure 4:
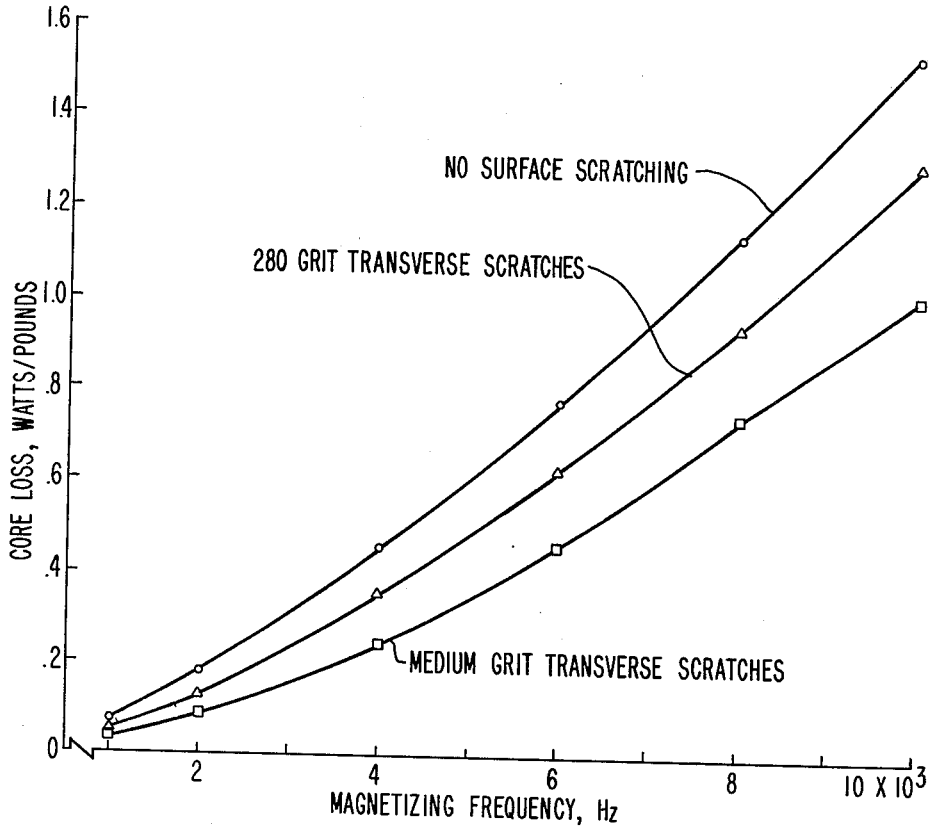
FIG. 4 shows the effect of scratch roughness on the 1 kG losses on magnetically annealed 2605A.
Figure 5:
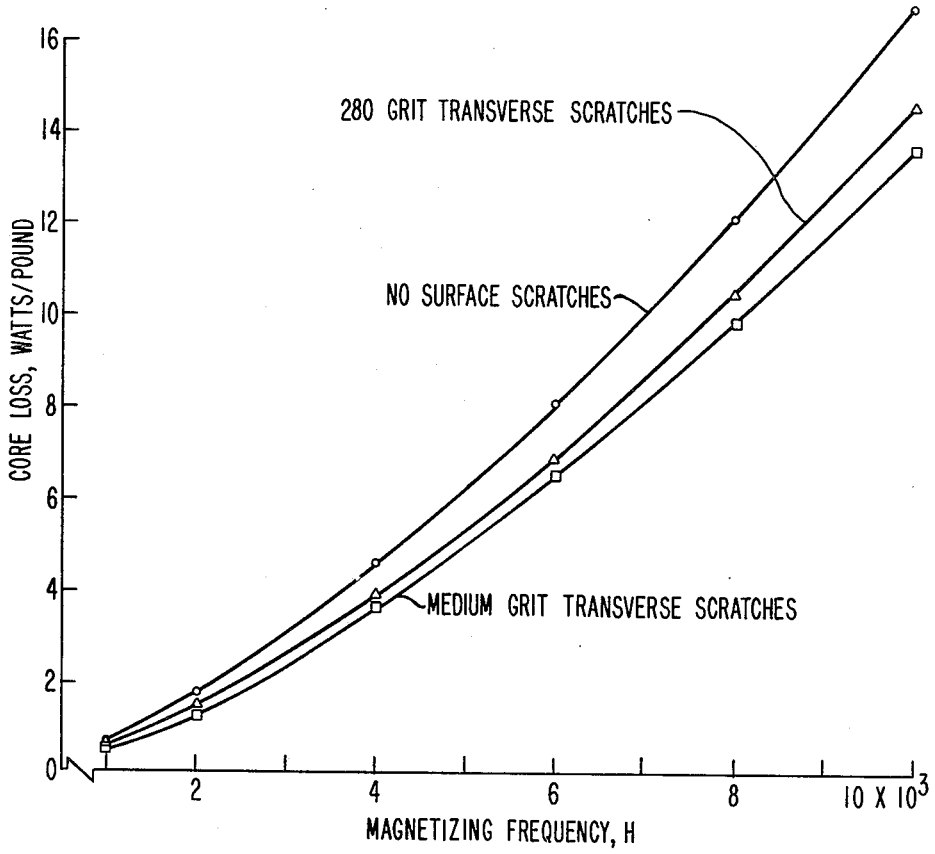
FIG. 5 shows the effect of scratch roughness on the 4 kG losses of magnetically annealed 2605A.

If transverse surface scratches reduce losses by altering the magnetostatic energy it would be expected that, within some as yet undefined limit, the deeper the scratch, the lower the losses, assuming, of course, that the level of residual stresses due to scratching is eliminated by the anneal. Three cores were wound with alloy 2605A and magnetically annealed at 325° C. as described in the previous examples. Core 1 was in the unscratched condition while cores 2 and 3 were scratched in the transverse direction. Core 2 was scratched with 280 grit emery paper while core 3 was scratched more deeply using a rougher medium grit emery paper. The results are shown in TABLE V below. FIGS. 4 and 5 present the 1 and 4 kG data respectively. As can be seen, the losses are, in fact, further reduced by the use of the rougher paper. Apparently, the reduction in losses due to the use of deeper grooves from the rougher paper are greater than any impairment caused by residual stresses.

TABLE V

EFFECT OF SCRATCH ROUGHNESS ON THE CORE LOSS OF ALLOY 2605A MAGNETICALLY ANNEALED AT 325° C.

| Test | Core Loss, Watts/Pound | | | | | |
|---|---|---|---|---|---|---|
| Frequency | .5 kG | 1 kG | 2 kG | 3 kG | 4 kG | 5 kG |
| No Surface Scratching | | | | | | |
| 1000 | .018 | .068 | .233 | .445 | .672 | .922 |
| 2000 | .048 | .180 | .602 | 1.15 | 1.78 | 2.43 |
| 4000 | .120 | .455 | 1.55 | 2.93 | 4.61 | 6.47 |
| 6000 | .204 | .777 | 2.70 | 5.12 | 8.07 | 11.8 |
| 8000 | .298 | 1.14 | 3.89 | 7.58 | 12.1 | 17.8 |
| 10000 | .403 | 1.55 | 5.32 | 10.44 | 16.7 | 24.4 |
| Transverse Scratches-280 Grit Paper | | | | | | |
| 1000 | .011 | .047 | 180 | .360 | .566 | .807 |
| 2000 | .033 | .130 | .463 | .921 | 1.46 | 2.06 |
| 4000 | .094 | .362 | 1.26 | 2.44 | 3.91 | 5.65 |
| 6000 | .162 | .624 | 2.12 | 4.30 | 6.87 | 10.1 |
| 8000 | .248 | .947 | 3.23 | 6.57 | 10.5 | 15.5 |
| 10000 | .340 | 1.31 | 4.78 | 8.94 | 14.6 | 21.6 |
| Transverse Scratches-Med. Grit Paper | | | | | | |
| 1000 | .007 | .036 | .154 | .328 | .583 | .768 |
| 2000 | .023 | .091 | .370 | .820 | 1.38 | 1.98 |
| 4000 | .063 | .248 | .992 | 2.12 | 3.62 | 5.40 |
| 6000 | .115 | .456 | 1.73 | 3.80 | 6.51 | 9.66 |
| 8000 | .182 | .745 | 2.78 | 5.94 | 9.83 | 14.8 |
| 10000 | .256 | 1.01 | 3.76 | 8.02 | 13.7 | 20.6 |

Figure 6:
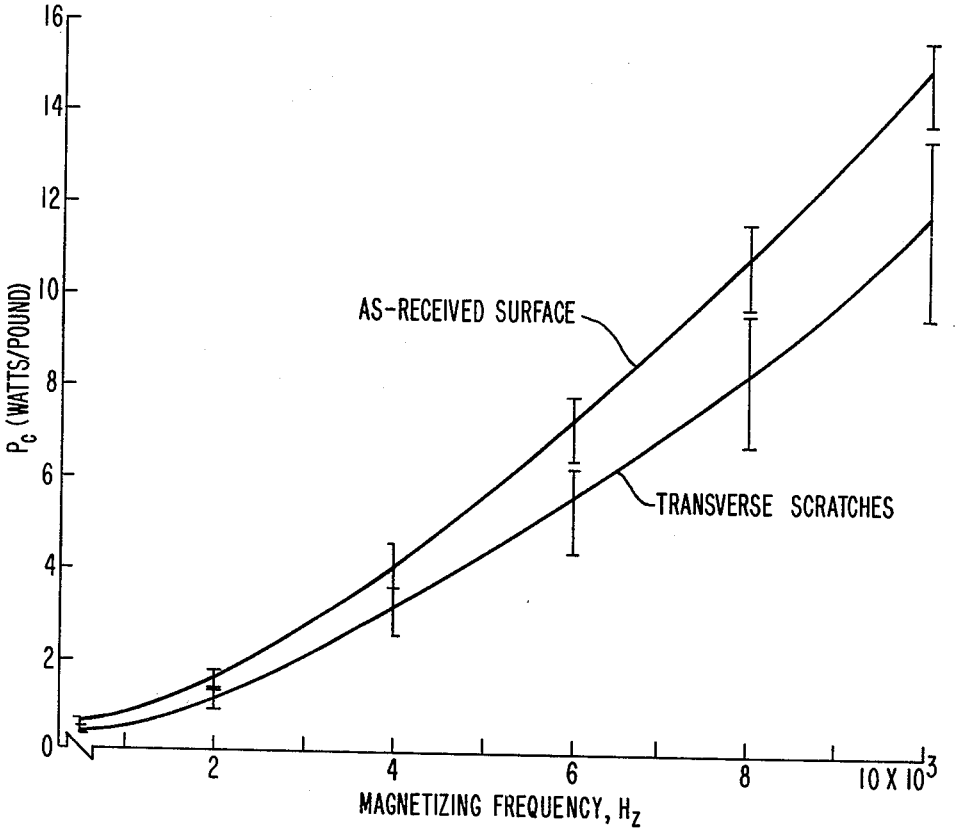
FIG. 6 shows the average (and data spread of six different anneals) effect of surface scratches on the 1 kG core loss ($P_c$) of magnetically annealed 2605A.
Figure 7:
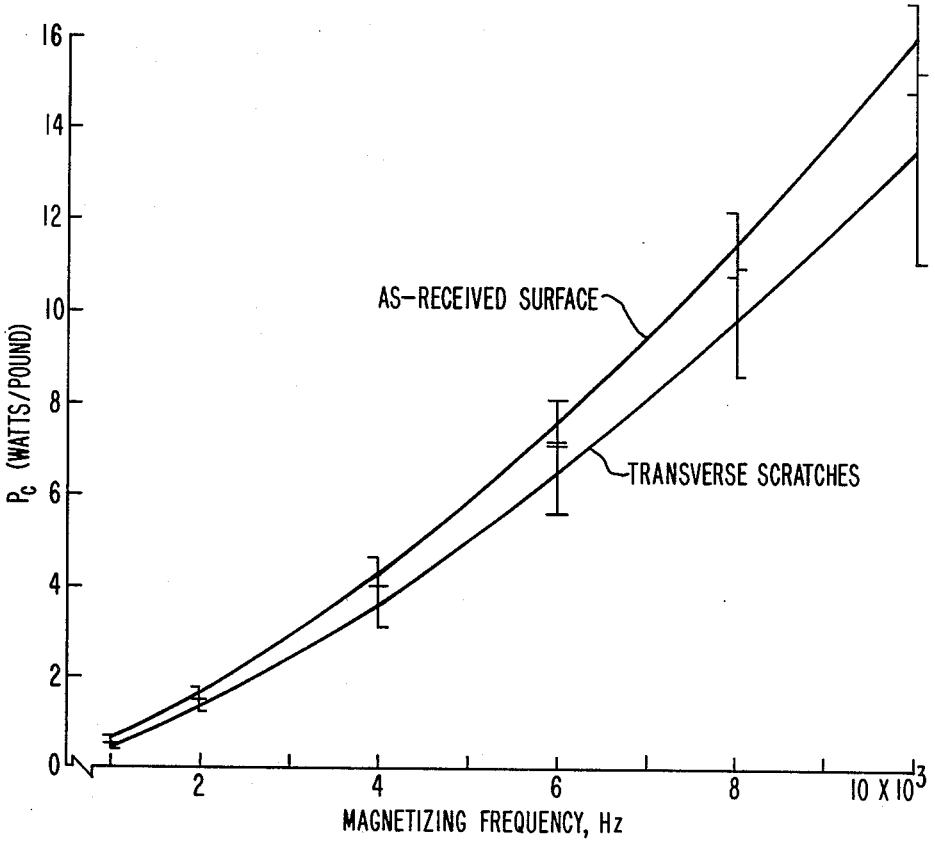
FIG. 7 shows the average (and data spread of six different anneals) effect of surface scratches on the 4 kG core loss of magnetically annealed 2605A.
Figure 8:
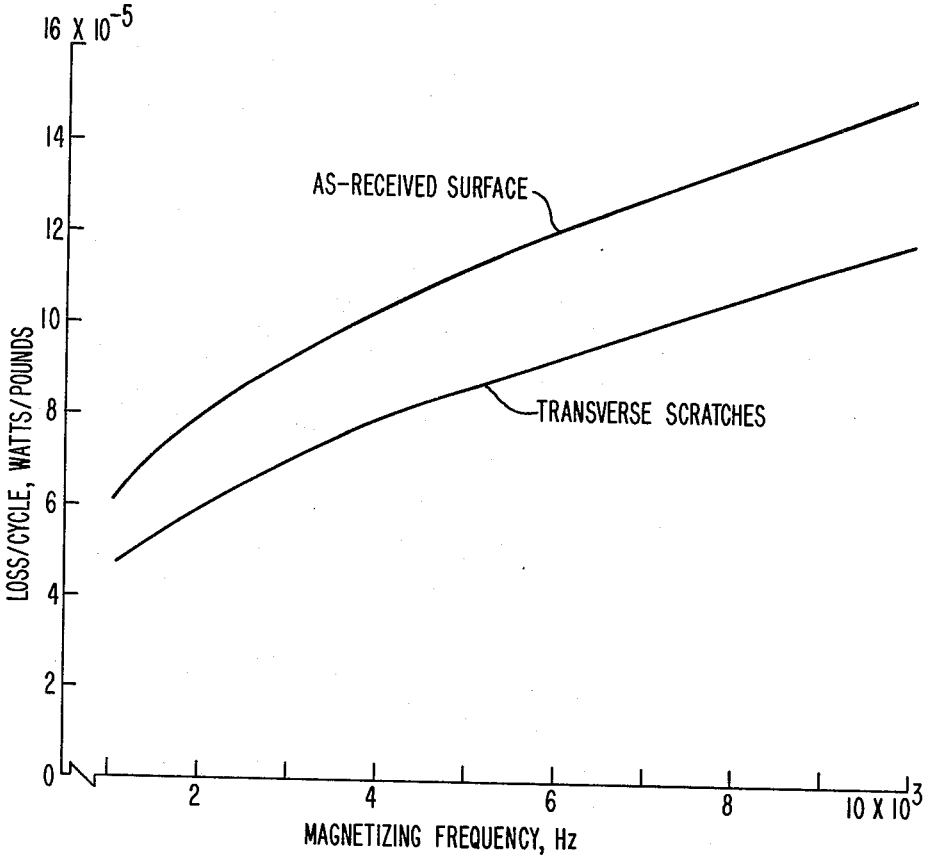
FIG. 8 shows the average effect of surface scratches on the 1 kG loss/cycle of magnetically annealed 2605A.
Figure 9:
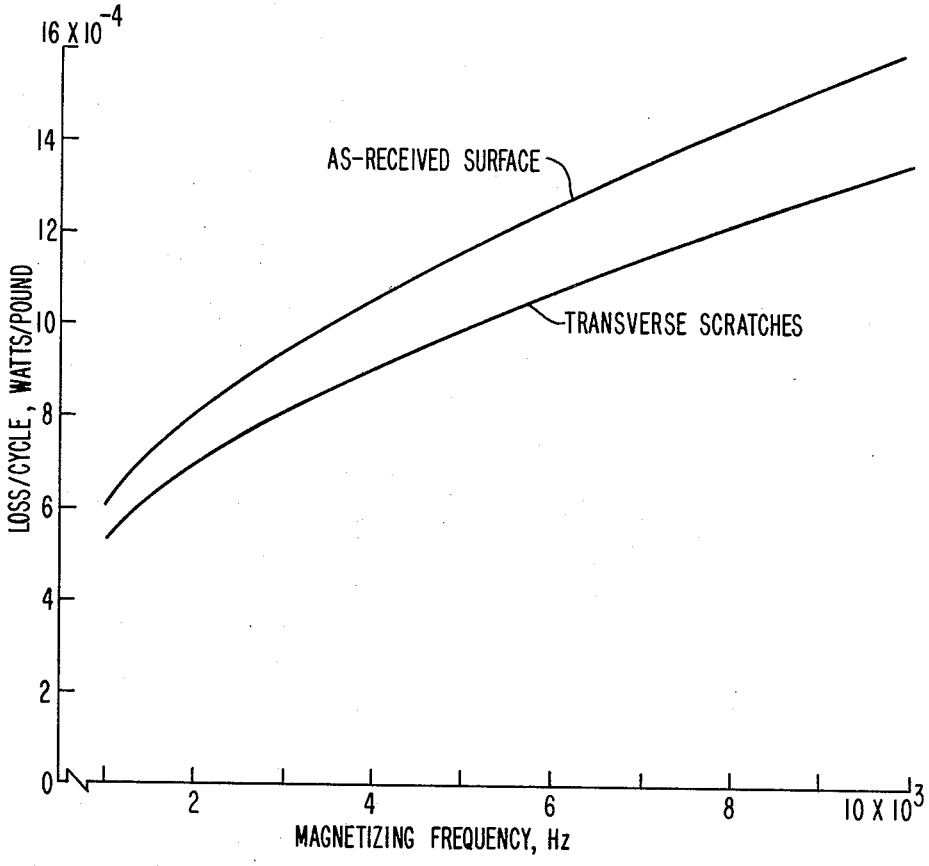
FIG. 9 shows the average effect of surface scratches on the 4 kG loss/cycle of magnetically annealed 2605A.

Because the loss values vary from core to core even when the cores are processed under identical conditions, the data presented in this example represents an average of 6 cores of 2605A that were wound, annealed, and tested on different dates. All cores were insulated, wound, and magnetically annealed for 2 hours at 325° C. Six cores were not scratched and six were scratched in the transverse direction with 280 grit emery paper. The results, FIGS. 6 and 7, confirm that transverse scratching results in an improved core loss. It can also be seen that this difference in losses between the scratched and unscratched cores increases as the magnetizing frequency increases (FIGS. 8 and 9).

Figure 10:
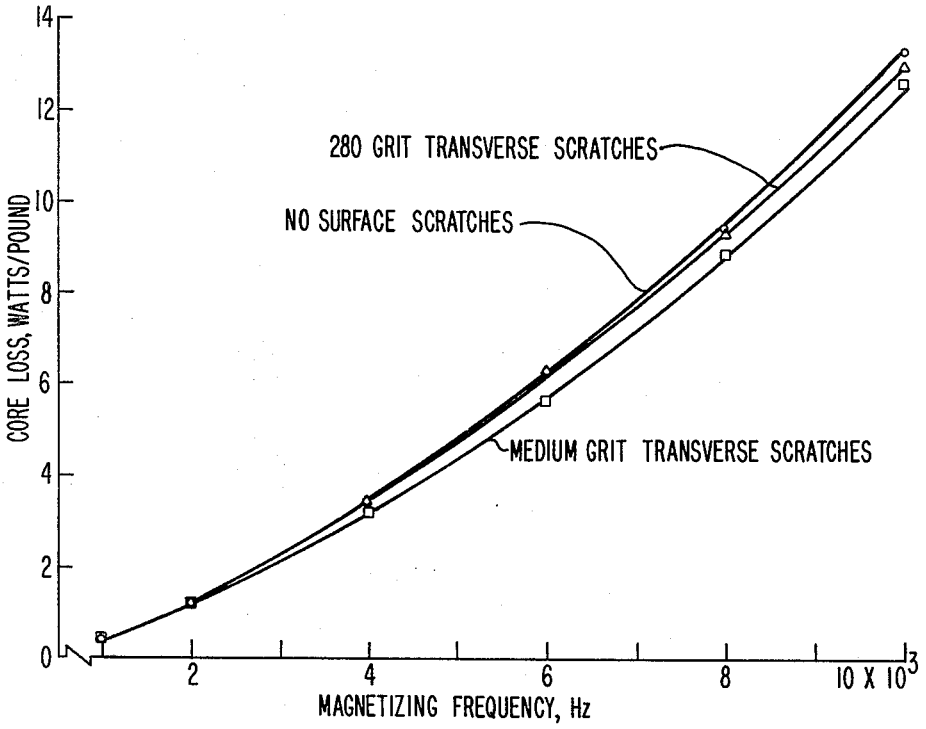
FIG. 10 shows the effect of scratch roughness on the 4 kG losses of magnetically annealed 2826.

Since the reduction in core loss appears to be a function of scratch depth, a deeper (rougher) scratch might be expected to improve the loss characteristics of the lower saturation alloy, 2826. Therefore, 3 cores of alloy 2826 were prepared and magnetically annealed at 325° C. The surface of core 1 was in the as-received condition, core 2 was scratched in the transverse direction with 280 grit emery paper, and core 3 was scratched in the transverse direction with medium grit emery paper. The results, TABLE IV below and FIG. 10 below, show a slight improvement in core loss when the rougher medium grit paper is used. While there is very slight improvement in the high frequency core loss of core 2 relative to core 1, this is probably due to variations during testing or variations in sample preparation.

TABLE VI

EFFECT OF SCRATCH ROUGHNESS ON THE CORE LOSS OF ALLOY 2826 MAGNETICALLY ANNEALED AT 325° C.

| Test | Core Loss, Watts/Pound | | | | | |
|---|---|---|---|---|---|---|
| Frequency | .5 kG | 1 kG | 2 kG | 3 kG | 4 kG | 5 kG |
| No Surface Scratching | | | | | | |
| 1000 | .016 | .052 | .163 | .307 | .447 | .632 |
| 2000 | .041 | .140 | .429 | .812 | 1.22 | 1.70 |
| 4000 | .124 | .413 | 1.20 | 2.21 | 3.41 | 4.80 |
| 6000 | .222 | .721 | 2.21 | 4.07 | — | 8.55 |
| 8000 | .039 | 1.10 | 3.38 | 6.17 | 9.43 | 13.2 |
| 10000 | .476 | 1.63 | 4.85 | 8.91 | 13.3 | 18.6 |
| Transverse Scratches-280 Grip Paper | | | | | | |
| 1000 | .018 | .055 | .171 | .324 | .475 | .659 |
| 2000 | .043 | .144 | .476 | .846 | 1.27 | 1.77 |
| 4000 | .121 | .423 | 1.27 | 2.28 | 3.50 | 4.90 |
| 6000 | .220 | .728 | 2.24 | 4.12 | 6.30 | 8.80 |
| 8000 | — | 1.13 | 3.44 | 6.31 | 9.36 | 13.0 |
| 10000 | .459 | 1.62 | 4.82 | 8.78 | 13.0 | 18.0 |
| Transverse Scratches-Medium Grit Paper | | | | | | |
| 1000 | .017 | .050 | .144 | .271 | .392 | .561 |
| 2000 | .036 | .119 | .402 | .721 | 1.12 | 1.57 |
| 4000 | .102 | .355 | 1.10 | 2.06 | 3.04 | 4.28 |
| 6000 | .191 | .617 | 2.03 | 3.66 | 5.68 | 8.05 |
| 8000 | .307 | .998 | 3.08 | 5.76 | 8.89 | 12.0 |
| 10000 | .401 | 1.55 | 4.46 | 8.22 | 12.6 | 17.2 |

Figure 11:
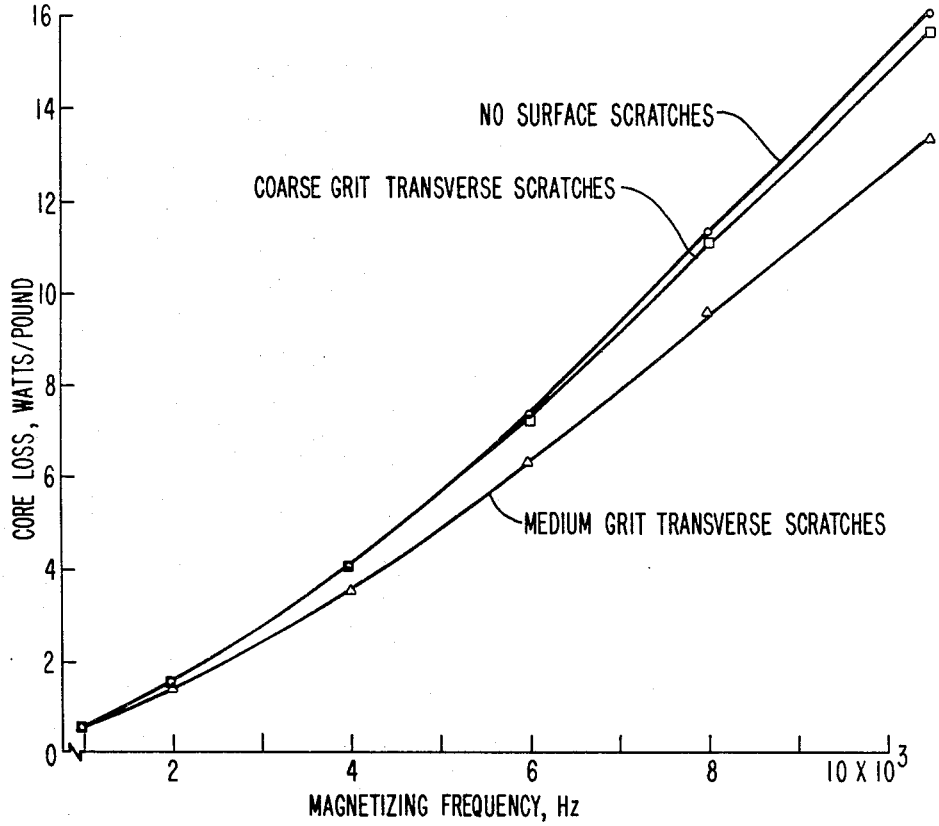
FIG. 11 shows the effect of scratch roughness on the 4 kG losses of magnetically annealed 2826MB.

A second low saturation alloy, 2826MB, was investigated. Three cores were prepared and magnetically annealed at 340° C. The surface of one core was in the as-received condition, the second core was scratched transverse to the strip axis with medium grit emery paper, and the third core was even more deeply scratched with coarse grit paper. The results, shown in TABLE VII below and in FIG. 11, indicated that the losses were decreased by scratching with the medium grit paper, but were not improved, relative to the as-received core, by scratching with the coarse grit emery. The most likely explanation is that the residual stresses induced by the scratching with the coarse emery were not completely removed by the subsequent anneal.

TABLE VII

EFFECT OF SCRATCH ROUGHNESS ON THE CORE LOSS OF METGLAS ALLOY 2826 MAGNETICALLY ANNEALED AT 340° C.

| Test | Core Loss, Watts/Pound | | | | | |
|---|---|---|---|---|---|---|
| Frequency | .5 kG | 1 kG | 2 kG | 3 kG | 4 kG | 5 kG |
| No Surface Scratching | | | | | | |
| 1000 | .020 | .063 | .186 | .352 | .543 | .746 |
| 2000 | .045 | .159 | .545 | 1.02 | 1.53 | 2.03 |
| 4000 | .140 | .509 | 1.58 | 2.78 | 4.08 | 5.50 |
| 6000 | .276 | 1.03 | 2.85 | 4.96 | 7.37 | 9.93 |
| 8000 | .456 | 1.60 | 4.40 | 7.65 | 11.4 | 15.4 |
| 10000 | .674 | 2.28 | 6.14 | 10.8 | 16.1 | 22.0 |
| Transverse Scratches-Medium Grit Paper | | | | | | |
| 1000 | .023 | .076 | .212 | .369 | .548 | .736 |
| 2000 | .044 | .157 | .506 | .922 | 1.40 | 1.92 |
| 4000 | .116 | .432 | 1.35 | 2.44 | 3.58 | 4.90 |
| 6000 | .208 | .773 | 2.37 | 4.18 | 6.34 | 8.79 |
| 8000 | .320 | 1.18 | 3.50 | 6.30 | 9.62 | 13.3 |
| 10000 | .458 | 1.66 | 4.81 | 8.76 | 13.4 | 18.7 |
| Transverse Scratches-Coarse Grit Paper | | | | | | |
| 1000 | .021 | .070 | .206 | .374 | .565 | .773 |
| 2000 | .047 | .162 | .543 | 1.02 | 1.54 | 2.07 |
| 4000 | .135 | .489 | 1.55 | 2.70 | 4.05 | 5.54 |
| 6000 | .254 | .919 | 2.71 | 4.84 | 7.29 | 9.88 |
| 8000 | .410 | 1.45 | 4.13 | 7.40 | 11.2 | 15.4 |
| 10000 | .601 | 2.07 | 5.76 | 10.3 | 15.7 | 21.8 |

The foregoing experimental results tend to confirm the hypothesis that the magnetoelastic energy can be modified by grooving the surface transverse to the direction of magnetization and thus reduce the core loss of amorphous magnetic alloys. The results obtained by scratching with emery paper are clearly not optimum but prove that losses can be significantly reduced. Long grooves (e.g. the entire width of the strip) are desirable and grooves should have a length at least ten times their depth and should have a width of between about ¼ and 50 times their depth. Grooving at any angle (other than parallel to the direction of magnetization) should provide some improvement, however, optimum results are given when the scratches are transverse. Groove spacing should generally be between about 0.02 and 2 centimeters. The relatively small spacing given by the emery paper results in relatively high hysteresis loss increases and greater groove spacing is especially desirable at lower frequencies. As the hysteresis is proportional to frequency (and is increased by grooving) and the eddy current losses are proportional to the frequency squared (and are decreased by transverse grooving) it can be seen that the optimum spacing between grooves is a function of frequency and that a greater spacing should be used for lower frequencies.

Figure 12:
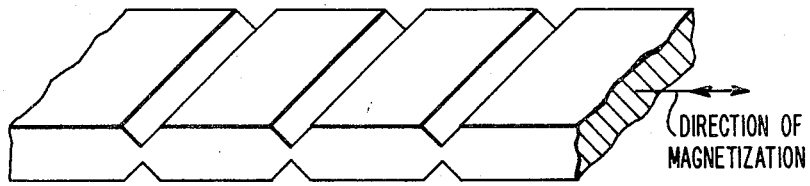
FIG. 12 shows a portion of an amorphous magnetic alloy strip with three transverse grooves on both surfaces.

Preferably both of the surfaces (top and bottom) are grooved as in FIG. 12. It can also be seen that neither the near edge nor the far edge in FIG. 12 are grooved as it is felt that this would provide little additional improvement.

The grooving can, of course, be done in a number of manners. While scratching with emery paper is effective, various types of tools can be used to groove the surface of strips of amorphous magnetic alloys. The surface can be grooved during casting (e.g. by ridges on the surface of the cylinder which is used to rapidly cool the jet of liquid metal).

The invention is not to be construed as limited to the particular forms described herein, since these are to be regarded as illustrative rather than restrictive. The invention is intended to cover all configurations which do not depart from the spirit and scope of the invention.

I claim:

1. In combination with a strip of magnetic material of the type wherein the body of the strip is substantially composed of amorphous magnetic metal alloy and magnetized in a predetermined direction at a frequency of at least 1000 hertz, the loss reducing improvement which comprises:

at least three grooves on at least one surface of said strip, said grooves having a depth of between 0.1 and 10% of the strip thickness and running generally transverse to the direction of magnetization.

2. The strip of claim 1, wherein said strip has at least three grooves transverse to the direction of magnetization on both surfaces.

3. The strip of claim 2, wherein the width of said grooves is being about ¼ the depth and 50 times the depth.

4. The strip of claim 3, wherein grooves are spaced between about 0.02 and 2 centimeters along the direction of magnetization.

* * * * *